US010803714B1

(12) United States Patent
Khera

(10) Patent No.: US 10,803,714 B1
(45) Date of Patent: Oct. 13, 2020

(54) SYSTEM AND METHOD FOR VISUALIZING, TRACKING AND MAINTAINING SOCIAL DISTANCING

(71) Applicant: Rajeev Khera, Orlando, FL (US)

(72) Inventor: Rajeev Khera, Orlando, FL (US)

( * ) Notice: Subject to any disclaimer, the term of this patent is extended or adjusted under 35 U.S.C. 154(b) by 0 days.

(21) Appl. No.: 16/898,283

(22) Filed: Jun. 10, 2020

Related U.S. Application Data

(60) Provisional application No. 63/027,062, filed on May 19, 2020.

(51) Int. Cl.

| | |
|---|---|
| ***G08B 5/36*** | (2006.01) |
| ***G08B 21/22*** | (2006.01) |
| ***F21V 14/00*** | (2018.01) |
| ***F21V 21/088*** | (2006.01) |

(52) U.S. Cl.
CPC ..... *G08B 5/36* (2013.01); *F21V 14/006* (2013.01); *F21V 21/0885* (2013.01); *G08B 21/22* (2013.01)

(58) Field of Classification Search
CPC combination set(s) only.
See application file for complete search history.

(56) References Cited

U.S. PATENT DOCUMENTS

2004/0246129 A1* 12/2004 Goggin ..... G08B 21/24 340/539.23
2010/0283590 A1* 11/2010 Tee ..... B62J 6/04 340/432
2011/0057805 A1* 3/2011 Loepfe ..... G08B 17/107 340/628
2011/0273293 A1* 11/2011 Itkin ..... G08B 13/184 340/557
2015/0070164 A1* 3/2015 Schalk ..... A01M 29/00 340/539.1

FOREIGN PATENT DOCUMENTS

EP 1508513 A1 * 2/2005 ..... B62J 6/165

* cited by examiner

*Primary Examiner* — Travis R Hunnings
(74) *Attorney, Agent, or Firm* — Jason T. Daniel, Esq.; Daniel Law Offices, P,A.

(57) ABSTRACT

A system and method for visualizing, tracking and maintaining social distancing includes a visible boundary generating device having a lighting unit that is disposed within a main body, a user attachment mechanism and a controller for selectively communicating with an external processor enabled device. The lighting unit functioning to generate a visible zone of colored light in 360 degrees around a user to whom the device is secured. The visible light representing a safe zone having a radius that conforms to a specified social distance. The system also including a social distancing mobile application for execution on a smartphone or other processor enabled device. The social distancing mobile application including functionality for sending location information to a system administrator device, receiving proximity alerts from the system administrator device and providing notification to a user.

19 Claims, 7 Drawing Sheets

SYSTEM AND METHOD FOR VISUALIZING, TRACKING AND MAINTAINING SOCIAL DISTANCING

CROSS-REFERENCE TO RELATED APPLICATIONS

This application claims the benefit of U.S. Application Ser. No. 63/027,062 filed on May 19, 2020, the contents of which are incorporated herein by reference.

TECHNICAL FIELD

The present invention relates generally to maintaining social distancing, and more particularly to a device and system for visualizing, tracking and maintaining safe separation distances between individuals.

BACKGROUND

The statements in this section merely provide background information related to the present disclosure and may not constitute prior art.

Owing to the recent spread and transmission of communicable viruses such as COVID-19, for example, doctors and governments around the world are asking individuals to maintain minimum recommended separation distances with other individuals. Although the concept of maintaining an appropriate "social distance" is easy to understand in the abstract, it is somewhat difficult to maintain in reality.

One of the biggest reasons groups of people fail to maintain proper social distancing is because there is no easy way for everyone to immediately realize they are too close together. Indeed, when viewing gatherings of people, it is easy to see that the recommended guidelines are compromised very quickly. This is especially true for children and persons with disabilities such as the vision impaired, for example.

In addition to the above, there is no current system in place to provide individuals with an active notification (e.g., visual, audible or tactile) that they have come in close proximity—less than the recommended distance guidelines, and therefore are not available for detective, after the fact action or analysis, as well as preventive measures.

In light of the above, many establishments have implemented signs and other physical markings to provide some type of visual cue to maintain spacing. Although such items are useful, they do not afford individuals with any type of protection or notice when they are not in the actual merchant location. Additionally, without tracking data, such locations are not able to identify instances of overcrowding within their establishments.

Accordingly, it would be beneficial to provide a device which can continually provide a visible safe zone about a user that represents the boundaries for proper social distancing. It would also be beneficial if the device was tied to a system and method of providing user notifications when the safe zone has been breached by another individual, and for providing analytics regarding social distancing, proximity and capacity within a given area, so as to alleviate the drawbacks described above.

SUMMARY OF THE INVENTION

The present invention is directed to a system and method for visualizing, tracking and maintaining social distancing. One embodiment of the present invention can include a visible boundary generating device having a lighting unit that is disposed within a main body, and a controller for selectively communicating with an external processor enabled device. The controller can function to control the operation of the lighting unit so as to generate a visible zone of colored light in 360 degrees around a user to whom the device is secured. The visible light representing a safe zone having a radius that conforms to a specified social distance.

In one embodiment, the system can include a social distancing mobile application for execution on a smartphone or other processor enabled device. The social distancing mobile application can include functionality for allowing a user to adjust the lighting unit of the visible boundary generating device remotely.

In one embodiment, the system can include a system administrator device that is communicatively linked to the social distancing mobile application and can receive location information from the processor enabled device to which the social distancing application is installed. The system administration device can detect if another processor enabled device is within a distance that is less than the specified social distance and send a proximity alert to both devices.

In one embodiment, the social distancing application can include functionality for selectively activating one or more of the speaker, display, light or vibration unit of the processor enabled device upon receipt of the proximity alert, and can further instruct the visible boundary generation device to change a lighting color.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, the term "social distancing" refers to the act of keeping a specific physical distance between individuals to reduce the spread of contagions.

As described herein, the term "safe zone" refers to the specific physical distance between individuals that is outlined by the social distancing guidelines a user is following.

As described herein, the term "system administration" and "system administrator" can be used interchangeably to describe any individual, group or legal entity that is providing the system functionality for executing the system and method steps described below.

As described herein, a "unit" means a series of identified physical components which are linked together and/or function together to perform a specified function.

As described herein, the term "removably secured," and derivatives thereof shall be used to describe a situation wherein two or more objects are joined together in a non-permanent manner so as to allow the same objects to be repeatedly joined and separated.

Figure 1:
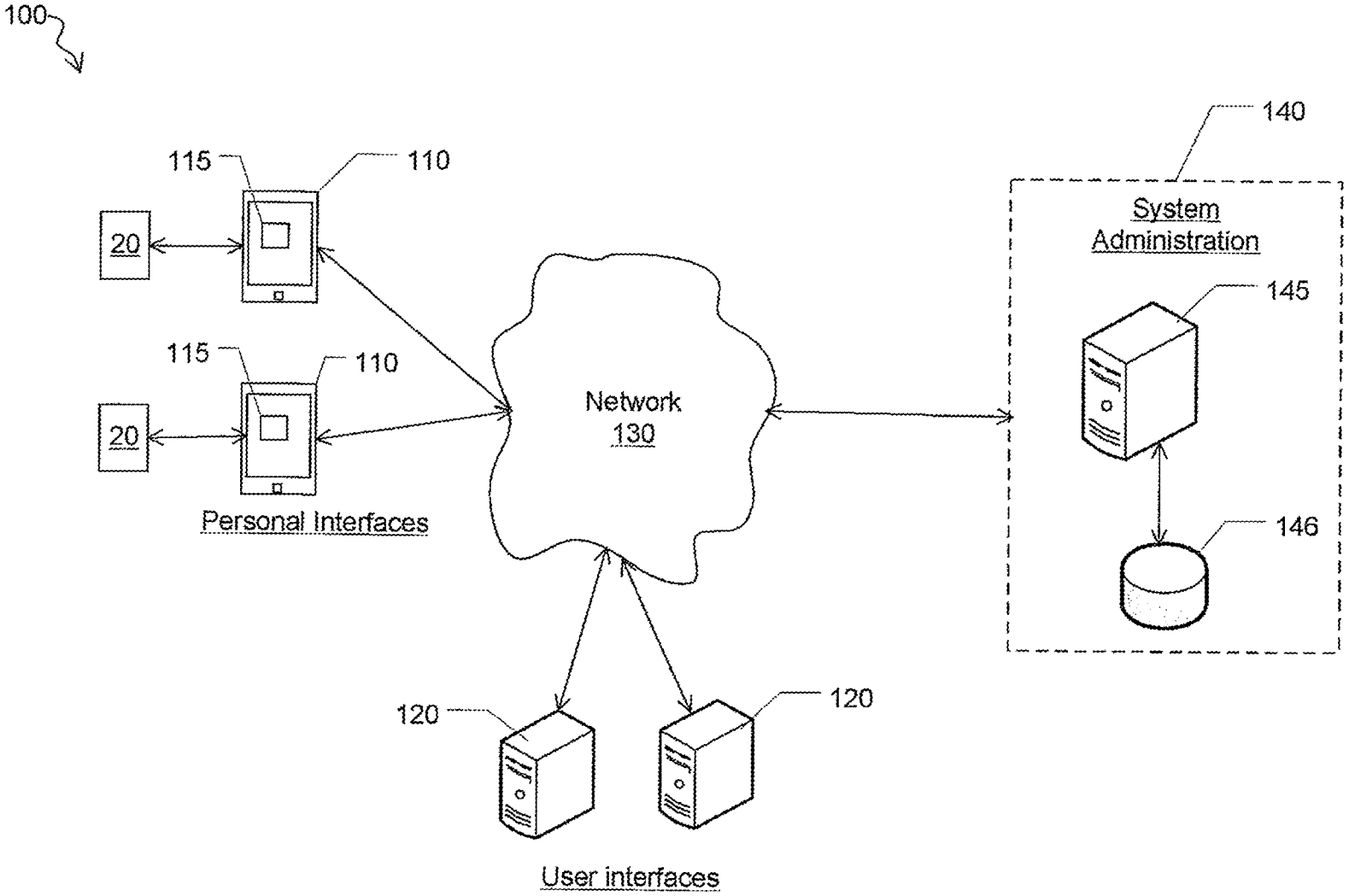
FIG. 1 shows an exemplary network environment of a system for visualizing, tracking and maintaining social distancing, according to some embodiments of the technology.

FIG. 1 is a schematic illustration of an exemplary operating environment 100 for implementing a system for visualizing, tracking and maintaining social distancing. In one embodiment, the system 100 can include one or more personal interface devices 110 that are each in communication with a designated visible boundary generating device 20, and one or more user interface devices 120, that can be connected over a network 130 with a system administration 140.

As described herein, the network 130 can be any type of network capable of facilitating communication between the system components. Several nonlimiting examples of suitable networks include, but are not limited to: cellular networks, local area networks ("LAN"), such as an intranet, wide area networks ("WAN"), the internet, and/or any other type of data transmission and reception mediums.

In the preferred embodiment, each of the personal interface devices 110 can include, comprise or consist of a smartphone or other portable processor enabled device. In such an embodiment, programming code for implementing the system functionality on the smartphone can preferably be presented in the form of a mobile application (i.e., App) 15 which can be preloaded on the smartphone device, or downloaded and installed as an application after purchase of the smartphone device.

As is known, smartphones and other portable processor enabled devices generally include installed software adapted to generate icons, such as the inventive social distancing icon that is included with the social distancing mobile application 115, and to display same on the display screen of the smartphone device. An actuating means is provided for actuating the icon through use of a touch sensitive smartphone or tablet screen, and/or a keypad, for example. Selecting the icon launches the system application and/or launches a linked web page through internet connectivity wherein the user can be presented with options for controlling the operation of the visible boundary generating device 20, receiving proximity notifications and the like.

Smartphone devices also include location tracking functionality for identifying the location of the device. Such functionality typically includes localization of the device via triangulation of cellular towers of the network provider and/or utilizing satellite based locating functionality such as GPS, for example. Such systems and methodologies are well known in the art.

Although described above with regard to a particular device, this is for illustrative purposes only. To this end, interface devices 110 and 120 can each be any type of computing device that is operable by a human user. A computing device refers to any device with a processor and memory that can execute instructions and communicate with another device. Computing devices include, but are not limited to, smartphones, tablet computers, personal computers, laptop computers and/or purpose-built machines that are pre-encoded with an application interface, so as to perform the functionality so described. In either instance, each of the computing devices can include one or more client applications, such as a conventional web browser, and/or an application interface, for example, which can allow the device to communicate with other interface devices and/or the system administration 140.

The system administration 140, according to one embodiment, can include one or more individual computing devices 145 that can be connected to one or more databases 146 on which various portions of the below described methodology can be performed. The system administration 140 can function to provide a central hub for controlling the communication between the interface devices 110 and 120, and/or each of the visible boundary generating devices 20 through any number of different mediums such as a website, mobile application, secure application or email, for example. In this regard, one or more of the individual computing devices 145 can include various web servers, email servers, application database servers and so forth.

The database 146 can function to store any type of data, including the system operating instructions for facilitating communication between the device components, routing information and/or generating presentation screens for allowing end users to operate the system devices. To this end, the database can include any type of computer-readable storage mediums, including all forms of volatile and non-volatile memory such as, for example, semiconductor memory devices, e.g., DRAM, SRAM, EPROM, EEPROM, and flash memory devices; magnetic disks, e.g., internal hard disks or removable disks; magneto-optical disks; and optical disks, e.g., CD, DVD, HD-DVD.

Figure 2A:
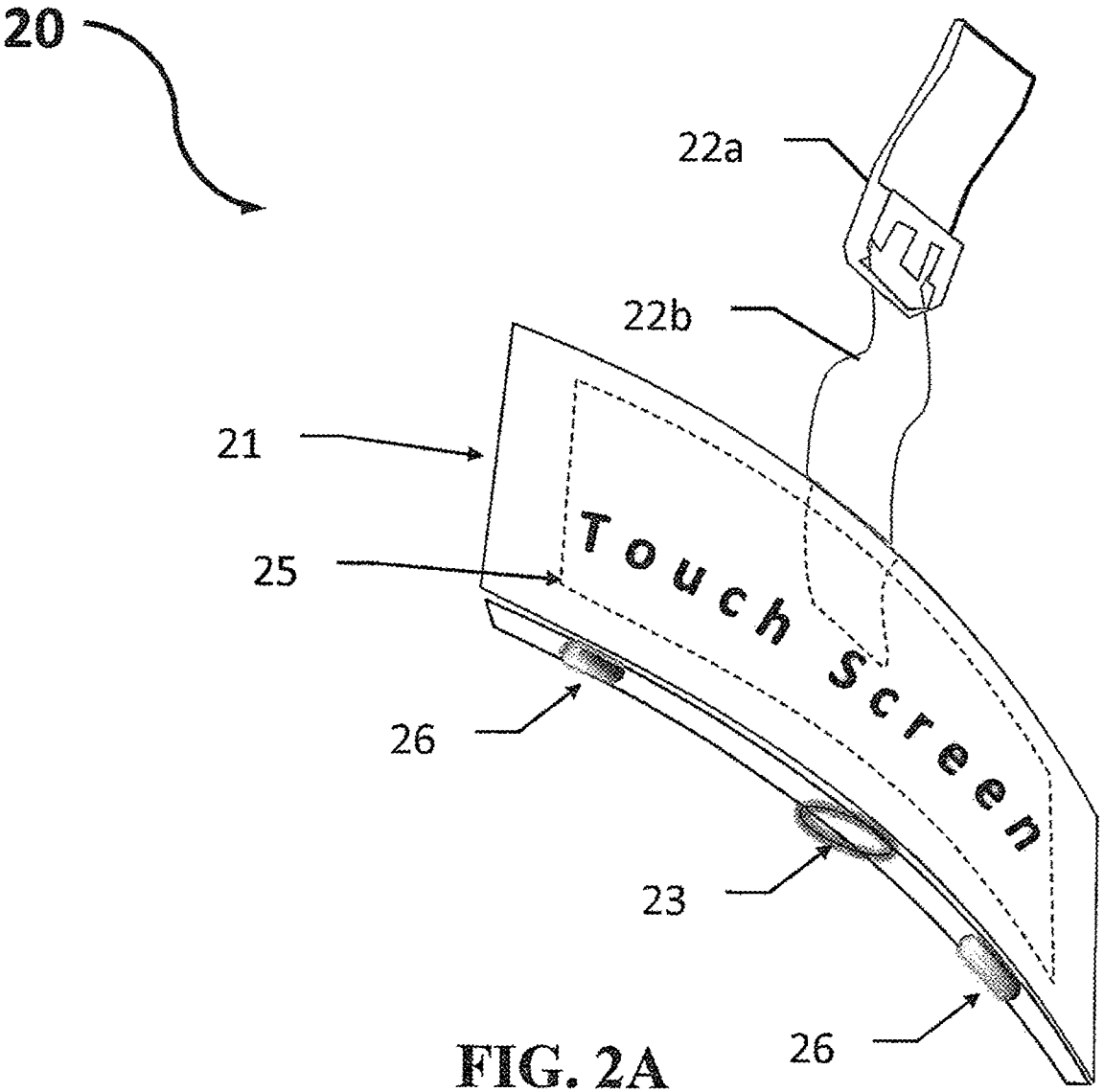
FIG. 2A is a top view of a visible boundary generating device, in accordance with one embodiment of the invention.
Figure 2B:
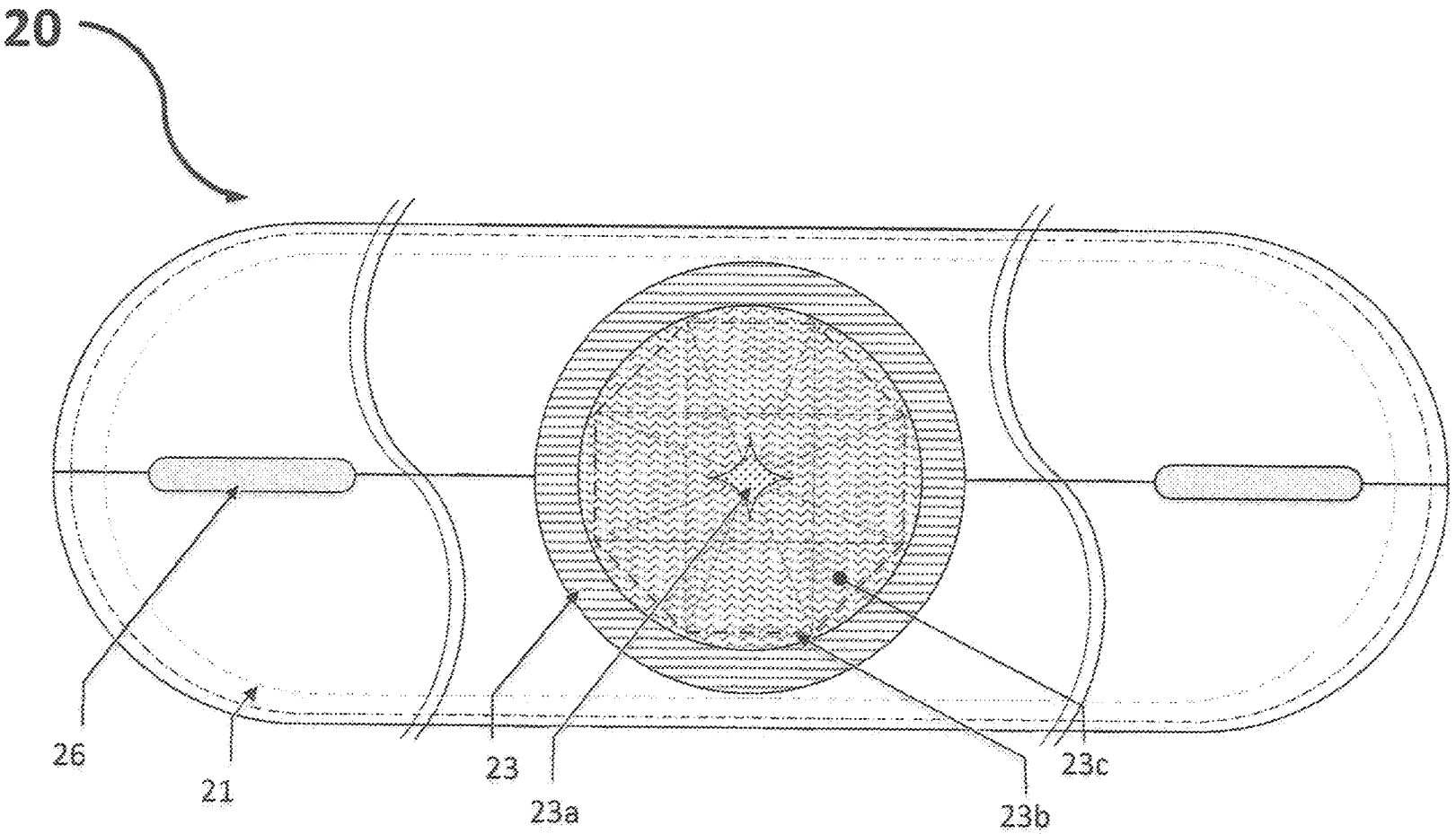
FIG. 2B is a bottom view of a visible boundary generating device, in accordance with one embodiment of the invention.
Figure 2C:
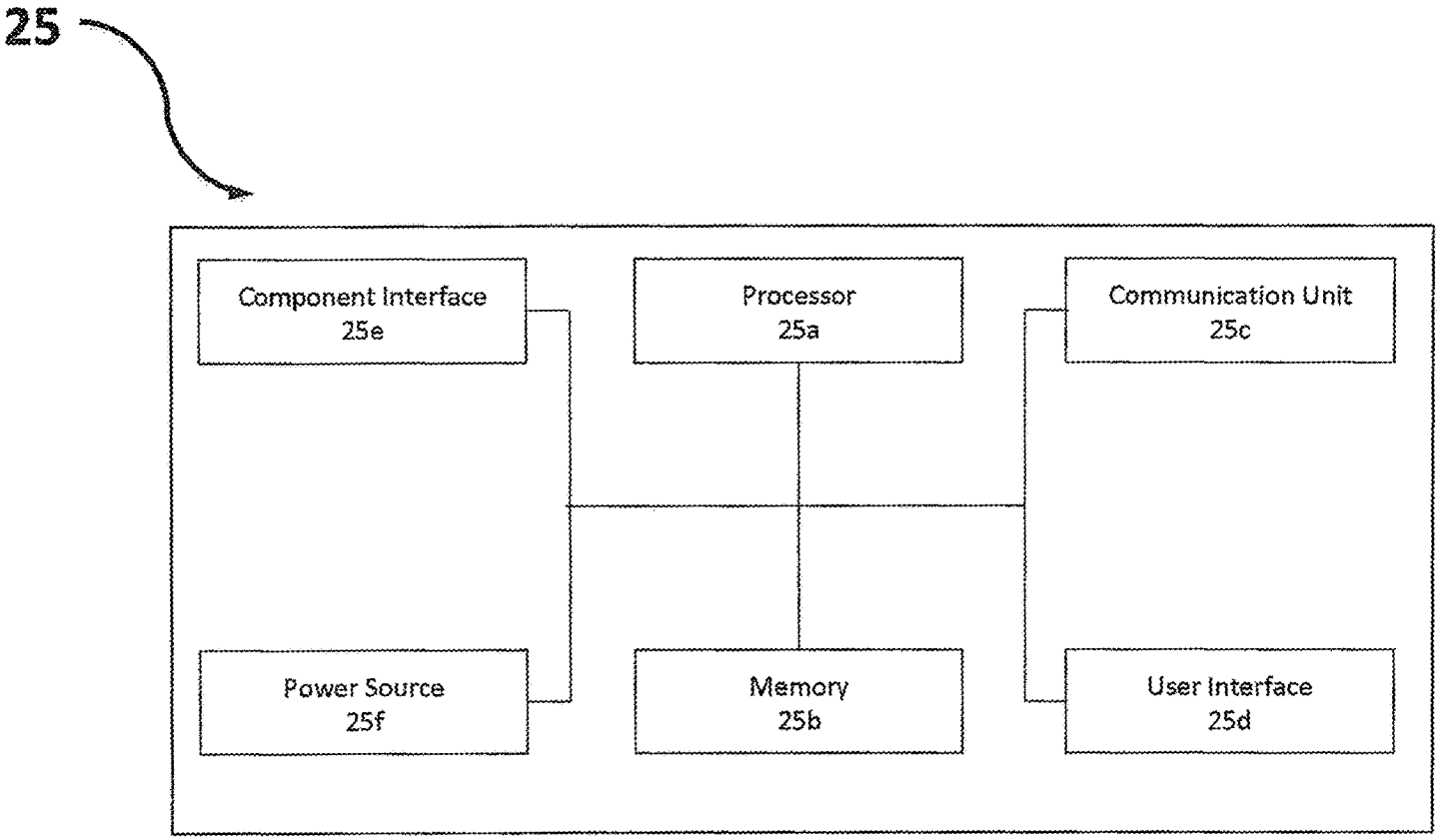
FIG. 2C is a simplified block diagram of the internal controller of the visible boundary generating device, in accordance with one embodiment of the invention.

FIGS. 2A-2C illustrate one nonlimiting embodiment of an exemplary visible boundary generating device 20 for use with the system 100. As shown, the device 20 can include, essentially, a main body 21, an attachment mechanism 22, and a lighting unit 23 that is in communication with a controller 25.

The main body 21 can include any number of different shapes and sizes, and can be constructed from any number of different materials suitable for encompassing each of the device elements. In the preferred embodiment, the main body 21 can be constructed from a waterproof and impact resistant material such as plastic, for example, having a plurality of internal connectors (not shown) for securely housing each of the device elements. Of course, any number of other known construction materials are also contemplated.

In one embodiment, the attachment mechanism 22 can include the illustrated clip 22*a* that is secured to the main body 21 via a tether 22*b*. Such a feature allowing the device to be easily clipped onto an article of clothing so as to worn on or about a user at all times, while orienting the output of the lighting unit downward.

Although described as including a clip and tether arrangement, this is for illustrative purposes only. To this end, the attachment mechanism 22 can include, comprise or consist of any number of other devices capable of removably securing the main body 21 onto a person directly, or onto a secondary object. Several nonlimiting embodiments include, but are not limited to: bracelets, headbands, hats, opposing strips of hook and loop material (i.e. Velcro®), attractively-oriented magnetic elements or magnetic and metallic elements, and/or flexible strips of interlocking projections with a slider (i.e., zipper), tethers, buckles such as side release buckles, and/or compression fittings such as T-handle rubber draw latches, hooks, snaps and buttons, for example.

As shown best at FIG. 2B, the lighting unit 23 can preferably be positioned along the bottom surface of the main body 21, and can include any number of light producing devices 23*a* that are capable of generating sustained visible light in any spectrum and intensity. Several nonlimiting examples of the light producing devices include, but are not limited to low powered laser diodes and/or monochrome LED's, for example.

In one embodiment, the lighting unit can also include a mirror 23*b* to focus and reflect light coming from the light producing device 23*a* and/or a lens 23*c* for diffracting or refracting the produced light. Such components functioning together to create a colored, cone of light that extends a predefined radius around the device 20 and a user to which the device is secured.

FIG. 2C illustrates one exemplary embodiment of the device controller 25 that includes a processor 25*a* that is conventionally connected to an internal memory 25*b*, a communication unit 25*c*, a user interface device 25*d*, a component interface 25*e*, and a power source 25*f*.

Although illustrated as separate elements, those of skill in the art will recognize that one or more system components may comprise or include one or more printed circuit boards (PCB) containing any number of integrated circuit or circuits for completing the activities described herein. Of course, any number of other analog and/or digital components capable of performing the below described functionality can be provided in place of, or in conjunction with the below described controller elements.

The processor 25*a* can be a conventional central processing unit (CPU) or any other type of device, or multiple devices, capable of manipulating or processing information such as program code stored in the memory 25*b* and for causing the circuitry to complete the activities and functionality described herein.

Memory 25*b* can act to store operating instructions in the form of program code for the processor 25*a* to execute. Although illustrated in FIG. 2C as a single component, memory 25*b* can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example, containing programs that permit the processor to perform the functionality described below. Additionally, memory 25*b* can also include one or more cache memories that provide temporary storage of at least some program code in order to reduce the number of times program code must be retrieved from the bulk storage device during execution. Each of these devices are well known in the art.

The communication unit 25*c* can include any number of components capable of sending and/or receiving electronic signals with an externally located device, either directly or over a network. In one preferred embodiment, the communication unit can include a Bluetooth transceiver for communicating wirelessly with the personal interface device 110 running the mobile application 115. However, any number of other known transmission and reception mechanisms and protocols can also be utilized herein, several nonlimiting examples include WiFi transceivers. Near-Field-Communication (NFC) devices, radio devices, infrared (IR) devices and/or network adapters for communicating over a WAN, LAN or the internet via an internet service provider, for example.

The user interface 25*d* can function to accept user inputs and/or to provide operating information to a device user. In various embodiments, the user interface can include or control one or more buttons/switches 26, that are connected to the processor 25*a* so as to activate various programmatic functions or control settings. For example, actuation of one or more of the switches 26 can result in the processor varying the output radius of the lighting unit, changing the wavelength of light produced by the lighting unit, powering the device ON and OFF, and/or pairing the device with the user interface 110, for example.

Although not specifically illustrated, the user interface 25*d* can also include any number of visual displays and/or two-way communication devices such as a touch screen Graphic User Interface (GUI), for example, that is capable of performing two-way communication with a device user.

The component interface 25*e* can function to provide a communicative link between the processor 25*a* and various other device components such as the lighting unit 23, for example. In this regard, the component interface can include any number of different components such as one or more PIC microcontrollers, internal bus, USB connections and other such hardware capable of providing a direct link between the various components. Of course, any other means for providing the two-way communication between the identified components can also be utilized herein.

In one preferred embodiment, the power source 25*f* can include one or more batteries capable of providing the necessary power requirements to each element of the device 20. In one embodiment, the batteries can be permanently located within the main body and can be rechargeable in nature via a charging port such as a mini or micro USB port, for example. Of course, traditional batteries can also be utilized and the main body can further include a battery compartment having a removable cover for allowing a user to access the same.

Figure 3A:
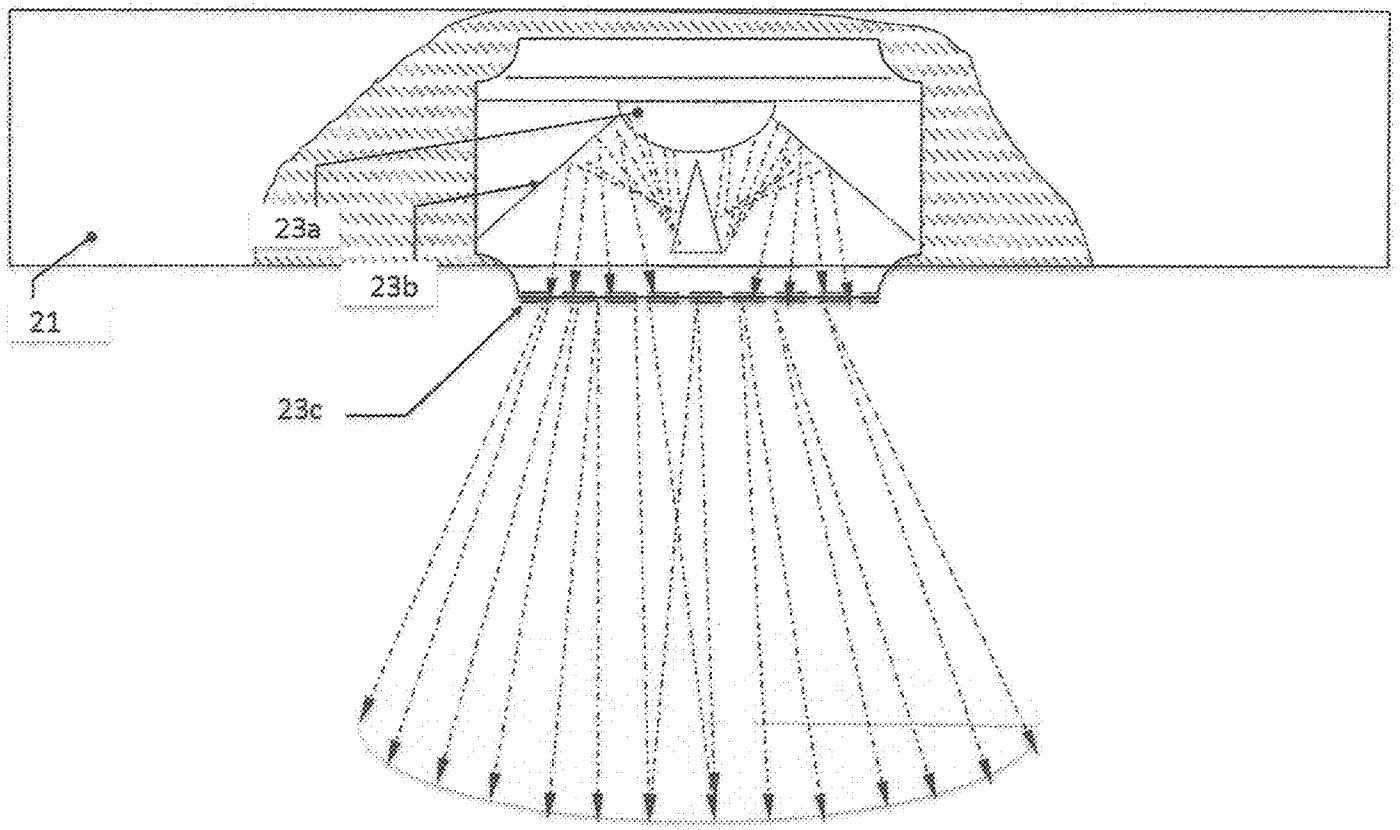
FIG. 3A is a side view of the visible boundary generating device in operation, in accordance with one embodiment of the invention.

FIGS. 3A and 313 illustrate one embodiment of the visible boundary generating device 20 in operation. As shown, the device 20 can be secured onto a user 1 and can function to generate a clearly visible lighted safe zone 30 around the user 1. The size/radius of the lighted safe zone can be defined or chosen through actuation of the application 115 on the personal interface device 110. In this manner, the application can include functionality for increasing or decreasing the amount of light generated by the device based on the height of the device from the ground and/or through various calibration programs. In either instance, individual users can establish their own preferred radius and/or the system can set the radius to conform to current recommended guidelines.

As shown, when two or more individuals 1 and 1' do not maintain the specified social distance that is represented by the visible safe zones 30 and 30' the light produced by both devices will become blended, thus creating a clearly visible intrusion area 35. Such a feature provides both users with a clear indication that they are not currently maintaining proper social distancing.

Accordingly, use and operation of the device 20 functions to provide a clearly visible personal, objective safe zone for a user to which the device is secured, so as to allow the user and others nearby to maintain the predefined separation distance at all times.

Although described above as utilizing a single device 20 per user, this is for illustrative purposes only. To this end, other embodiments are contemplated wherein multiple devices 20 can be interconnected and positioned on or about a single user so as to ensure the visible safe zone extends 360 degrees around the user at all times.

Figure 4:
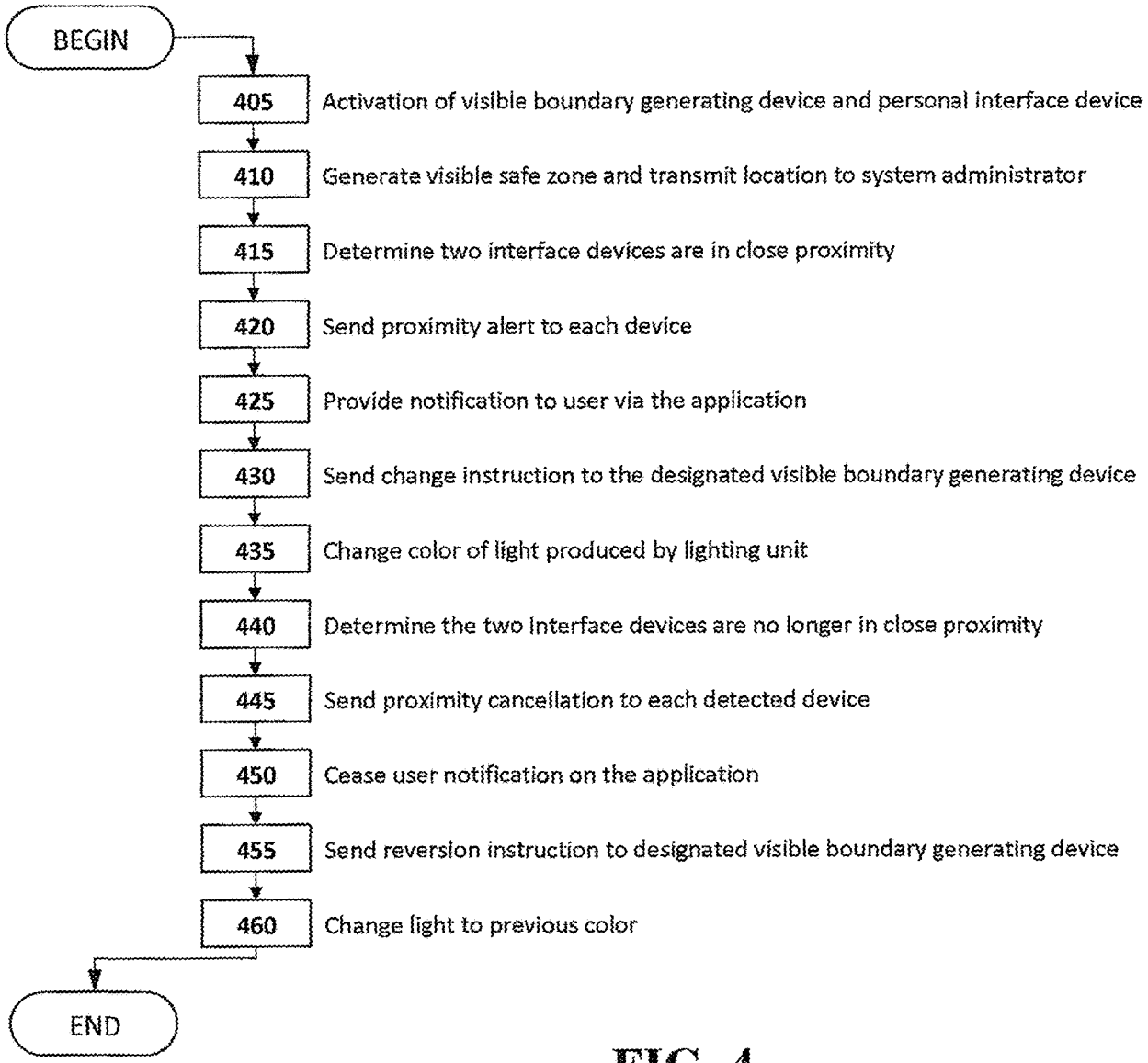
FIG. 4 is an exemplary flowchart illustrating a method of visualizing, tracking and maintaining social distancing, in accordance with one embodiment of the invention.

FIG. 4 is a flow chart illustrating an exemplary method for tracking and maintaining social distancing utilizing the system 100.

The method 400 can begin at step 405 wherein a visible boundary generating device 20 is secured to a user and is communicatively linked to a personal interface device 110 having the social distancing mobile application 115 installed thereon. Once linked, the user can establish operating preferences with the device 20 such as changing the default color of the light produced by the lighting unit 23, adjusting the radius of the lighting unit and the like.

Figure 3B:
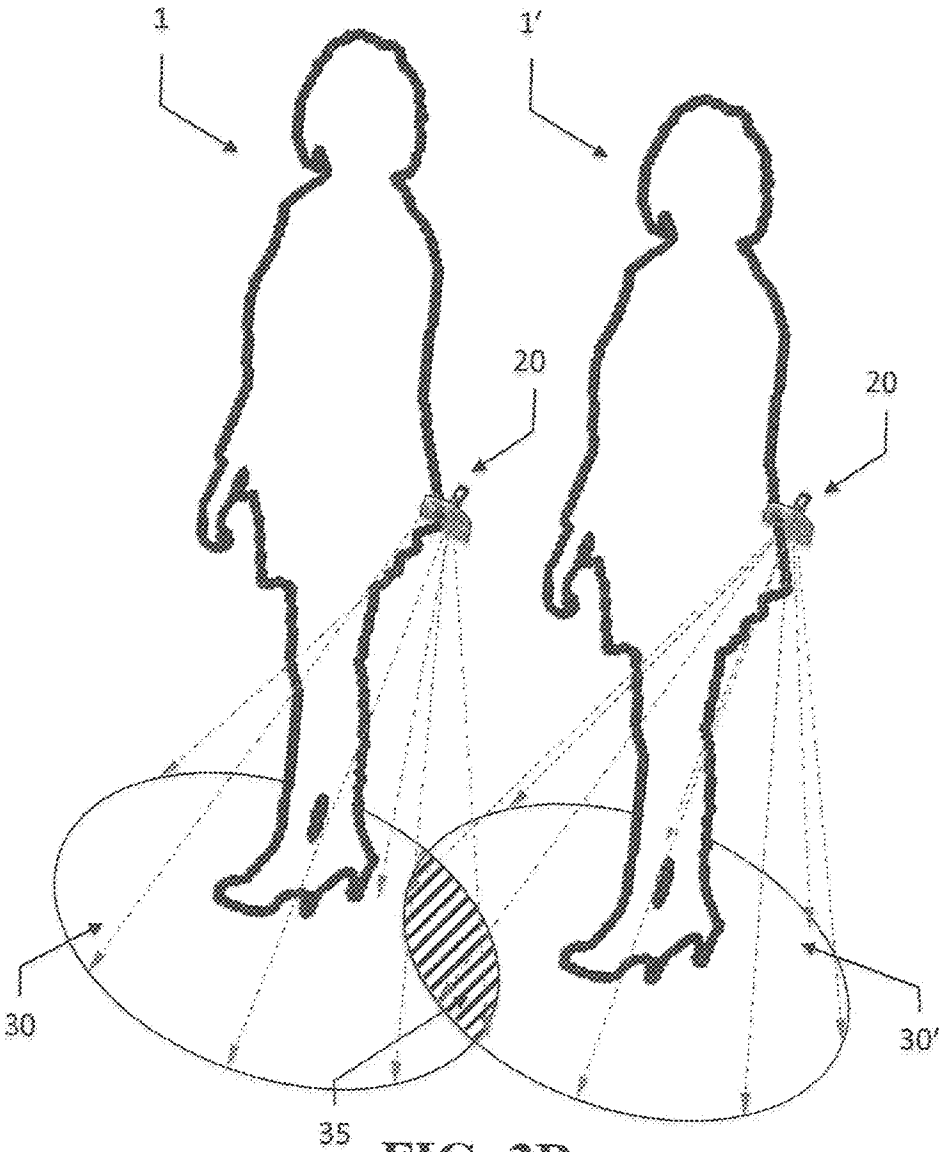
FIG. 3B is a perspective view of the visible boundary generating device in operation, in accordance with one embodiment of the invention.

At step 410, the visible boundary generating device 20 can function to generate the visible safe zone about the user—as described at FIG. 3—and the mobile application 115 can transmit location information of the personal interface device 110 to the system administrator 150. This information can be sent continually, periodically, or in response to a request from the system administrator and/or the device user.

At step 415, the system administrator can continually monitor the received location information to determine if/when two or more devices are within a specific proximity to each other that is less than the specified separation distance for either device. Upon determining that social distance is not being maintained, the method can proceed to step 420, where the system administrator can send a proximity alert over the network to each of the identified devices.

At step 425, each of the identified interface devices 110 can receive the alert and can function to notify the device user. In various embodiments, this notification can include the application 115 activating an audible notification through the device speaker, a visual notification through the device screen or flashlight, and/or a tactile notification through the vibrate function of the smartphone itself. Of course, other forms of notification are also contemplated.

Next, the method can proceed to step 430 wherein the application 115 can instruct the interface device 110 to send a color change instruction to the visible boundary generating device 20. At step 435, the device can receive the instruction, and can change the visible color produced by the lighting unit so as to provide a clear visual warning to anyone nearby that they are within the social distance space of the device user.

At step 440, the system administrator can continue to monitor the location information of the identified devices to determine when the identified devices 110 have separated to a distance greater than the specified separation distance. Upon determining that proper social distancing is in effect via appropriate separation of the identified devices, the method can proceed to step 445 where the system administrator can send a proximity cancellation notification to the devices.

At step 450, the interface devices 110 can receive the proximity cancellation notification and the application 115 can terminate any audible, visible or tactile notifications. Next, the method can proceed to step 455 wherein the application 115 can instruct the interface device 110 to send a second color change instruction to the visible boundary generating device 20.

Upon receipt of the second instruction, the device 20 can change the visible color produced by the lighting unit back to the default color or the most recent user-selected color at step 460.

In addition to the functionality described above, the system 100 can allow users to selectively access information stored by the system administrator via one or more of the user interface devices 120. Although outside the scope of this document, it is contemplated that the system can provide various programmatic functions for allowing users of the interface devices 120 to utilize the captured data in any number of different ways. For example, the data can be made available to institutions and authorities managing public and private spaces to control and plan ahead efficiently and effectively.

In another example, the system administrator can include functionality for analyzing received data and metadata from the device(s) 110 and 20 along multiple dimensions to provide a total contagion related score for a user or population, referred to herein as a "risk of contagion," and the "safe surroundings." These scores can incorporate additional information such as (1) Physical Health, (2) average spatial distance over time, (3) Number of contacts or breaches, (4) Social Connectedness, (5) Nature of space (commercial, residential), and (6) regulatory guidelines.

Physical Health includes, among other things, an indication of not having respiratory difficulties, and diagnosed of COVID-19. Average spatial distance includes, among other things, a measure of physical separation between a wearer and the surrounding population. Number of contacts or breaches includes, among other things, an indication of having other persons come in contact with the wearer closer than the recommended minimum distance. Social Connectedness includes, among other things, an indication of a wearer venturing out in their day-to-day activities and coming in contact with society at large. Nature of space (commercial, residential), include, among other things, an indication of different nature of contacts, risk profile and others. Regulatory guidelines are objective; public guidelines asking population to physically distance themselves by a given measure.

Accordingly, the above described system and method for visualizing, tracking and maintaining social distancing provides users with a continuous visual indication of safe social distancing regardless of the user location, and provides active monitoring and alerts to device users and non-users alike when a social distancing incursion has been detected.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A system, comprising:

a visible boundary generating device that includes main body, a lighting unit that is disposed within the main body, and a controller that is disposed within the main body and is in communication with the lighting unit; and a social distancing application that includes machine readable instructions for execution on a processor enabled device, said application being configured to remotely control an operation of the visible boundary generating device.

2. The system of claim 1, wherein the lighting unit includes functionality for generating a continuous field of visible light in a 360-degree area about the main body.

3. The system of claim 2, wherein the application includes functionality for changing a color of the field of visible light.

4. The system of claim 2, wherein the application includes functionality for changing a radius of the field of visible light along the 360-degree area.

5. The system of claim 4, wherein the application includes functionality for automatically changing a radius of the field of visible light to correspond to a recommended social distance.

6. The system of claim 1, further comprising:

a system administrator device that is in communication with the social distancing application.

7. The system of claim 6, wherein the application includes functionality for determining a location of the processor enabled device and reporting the determined location to the system administrator device.

8. The system of claim 7, wherein the application includes functionality for receiving a proximity alert from the system administrator device.

9. The system of claim 8, wherein the application includes functionality for accessing at least one of a speaker, a display, a light and a vibration unit of the processor enabled device upon receipt of the proximity alert.

10. The system of claim 8, wherein the application includes functionality for changing a color output of the lighting unit of the visible boundary generating device upon receipt of the proximity alert.

11. The system of claim 1, further comprising:

an attachment mechanism that is secured along the main body, said attachment mechanism being configured to removably secure the main body to a secondary object.

12. The system of claim 11, wherein the attachment mechanism includes a tether having a clasp along a distal end.

13. A method, comprising:

providing a visible boundary generating device that includes a main body, a lighting unit that is disposed within the main body;

generating, via the lighting unit, a visible ring of colored light in a 360-degree area around the device, said visible ring of light representing a safe zone having a radius that conforms to a specified social distance;

connecting the visible boundary generating device to a processor enabled device having a social distancing application that includes machine readable instructions for execution on the processor enabled device; and remotely controlling an operation of the visible boundary generating device on the processor enabled device via the social distancing application.

14. The method of claim 13, further comprising:

reporting a location of the processor enabled device having the social distancing application to a system administrator device.

15. The method of claim 14, further comprising:

detecting, via the system administrator device that another processor enabled device is within a distance that is less than the specified social distance.

16. The method of claim 15, further comprising:

sending, via the system administrator device a proximity alert to each of the two or more detected processor enabled devices.

17. The method of claim 16, further comprising:

activating, via the social distancing application, at least one of a speaker, a display, a light or a vibration unit of the processor enabled device upon receipt of the proximity alert.

18. The method of claim 16, further comprising:

sending, via the social distancing application, a change color command to the lighting unit of the visible boundary generating device.

19. The method of claim 18, further comprising:

changing a color of light emanating from the lighting unit of the visible boundary generating device upon receipt of the change color command.

* * * * *